United States Patent [19]

Hinz

[11] Patent Number: 4,823,932

[45] Date of Patent: Apr. 25, 1989

[54] METHOD OF AND APPARATUS FOR MANIPULATING FILTER CIGARETTES

[75] Inventor: Werner Hinz, Lauenburg, Fed. Rep. of Germany

[73] Assignee: Körber AG, Hamburg, Fed. Rep. of Germany

[21] Appl. No.: 159,206

[22] Filed: Feb. 23, 1988

[30] Foreign Application Priority Data

Mar. 3, 1987 [DE] Fed. Rep. of Germany ..... 3706573

[51] Int. Cl.[4] ..... B65G 47/22

[52] U.S. Cl. ..... 198/450; 198/452; 198/951; 131/282

[58] Field of Search ..... 198/449, 450, 452, 951, 198/447; 131/282, 283

[56] References Cited

U.S. PATENT DOCUMENTS

| | | | |
|---|---|---|---|
| Re. 25,917 | 11/1965 | Steltzer . | |
| Re. 26,900 | 5/1970 | Bohn et al. . | |
| 3,158,251 | 11/1964 | Sicala et al. | 198/450 |
| 3,164,242 | 1/1965 | Schubert et al. . | |
| 3,176,825 | 4/1965 | Rudszinat . | |
| 3,245,414 | 4/1966 | Rudszinat . | |
| 3,306,306 | 2/1967 | Rudszinat . | |
| 3,308,832 | 3/1967 | Steltzer et al. . | |
| 3,340,757 | 9/1967 | Rudszinat . | |
| 3,527,234 | 9/1970 | Hinzmann . | |
| 3,535,003 | 10/1970 | Rudszinat et al. . | |
| 3,583,546 | 6/1971 | Koop . | |
| 3,586,006 | 6/1971 | Wendt . | |
| 3,685,633 | 8/1972 | Rudszinat et al. . | |
| 3,791,507 | 2/1974 | Kaeding et al. | 198/449 |
| 3,812,950 | 5/1974 | Rudszinat et al. . | |
| 4,051,947 | 10/1977 | Schumacher et al. . | |
| 4,281,670 | 8/1981 | Heitmann et al. . | |
| 4,503,867 | 3/1985 | Barbe et al. . | |
| 4,554,931 | 11/1985 | Born . | |
| 4,564,029 | 1/1986 | Hinzmann et al. . | |

FOREIGN PATENT DOCUMENTS

| | | | |
|---|---|---|---|
| 472190 | 6/1969 | Switzerland | 198/450 |

*Primary Examiner*—Robert J. Spar
*Assistant Examiner*—D. Glenn Dayoan
*Attorney, Agent, or Firm*—Peter K. Kontler

[57] ABSTRACT

A mass-producing filter tipping machine wherein two coaxial plain cigarettes of unit length are simultaneously severed to yield pairs of coaxial plain cigarettes of unit length which are moved apart to provide spaces for filter mouthpieces of double unit length. The filter mouthpieces are connected with the respective pairs of cigarettes of unit length by adhesive-coated uniting bands, and the resulting filter cigarettes of double unit length are subdivided into a series of formations of four coaxial filter cigarettes of unit length each wherein first and second outer filter cigarettes are respectively adjacent first and second inner filter cigarettes. Such formations are then converted into two rows of aligned filter cigarettes of unit length by staggering the outer cigarettes relative to the inner cigarettes, by pneumatically moving the thus staggered first outer cigarettes of successive formations into alignment with the second inner filter cigarettes of the respective formations, and by pneumatically moving the second outer filter cigarettes of successive formations into alignment with the first inner filter cigarettes of the respective formations.

17 Claims, 3 Drawing Sheets

METHOD OF AND APPARATUS FOR MANIPULATING FILTER CIGARETTES

CROSS-REFERENCE TO RELATED CASES

The apparatus of the present invention is similar to those described in the commonly owned copending patent applications Ser. Nos. 159,122 and 159,216, both filed Feb. 23, 1988.

BACKGROUND OF THE INVENTION

The invention relates to improvements in methods of and in machines for making rod-shaped smokers' products, especially to improvements in methods of and in machines for making filter tipped smokers' products, such as filter cigarettes, cigars or cigarillos. For the sake of simplicity, the following description will refer to filter cigarettes with the understanding, however, that the method and machine can be used with equal or similar advantage for the making of other filter tipped smokers' products.

It is known to make filter cigarettes in a so-called filter tipping machine (typical examples of such machines are those known as MAX and MAX S which are distributed by the assignee of the present application) wherein plain cigarettes of double unit length are subdivided into pairs of coaxial plain cigarettes of unit length, a filter mouthpiece of double unit length is placed between each pair of plain cigarettes of unit length to form therewith a group of three coaxial rod-shaped articles, and the articles of each group are thereupon connected to each other by adhesive-coated uniting bands each of which is convoluted around the respective filter mouthpiece of double unit length and around the adjacent inner end portions of the corresponding plain cigarettes of unit length. The resulting filter cigarettes of double unit length are severed midway between their ends so that each such cigarette yields a pair of coaxial filter cigarettes of unit length. One filter cigarette of each pair is torned end-for-end to ensure that the filter mouthpieces of all filter cigarettes of unit length will face in the same direction before the thus obtained single row of filter cigarettes of unit length is admitted into storage or into a packing machine. It is further customary to inspect the filter cigarettes of unit length in order to ascertain the condition of their wrappers and/or to ascertain the density of unattached ends of the respective plain cigarettes. It is also known to provide filter cigarettes with perforations in order to enable atmospheric air to penetrate into the column of tobacco smoke when the filter cigarette is lighted and the smoker draws tobacco smoke into her or his mouth.

Filter tipping machines normally receive plain cigarettes directly from a cigarette rod making machine, e.g., from a machine known as PROTOS which is distributed by the assignee of the present application. As a rule, a cigarette rod making machine (also called maker) turns out a signle continuous cigarette rod which is subdivided into plain cigarettes of unit length of multiple unit length, and the thus obtained cigarettes are then transported to storage or to the filter tipping machine. Certain recent types of cigarette rod making machines are designed to simultaneously produce two parallel cigarette rods which are subdivided by so-called cutoffs so as to yield files of plain cigarettes of unit length or multiple unit length. The plain cigarettes are delivered to filter tipping machines, to storage or directly to packing machines for plain cigarettes.

Commonly owned copending patent application Ser. No. 127,243 filed Dec. 1, 1987 by Peter Schumacher for "Apparatus for changing the direction of transport of rod-shaped articles of the tobacco processing industry" discloses an apparatus which can accept plain cigarettes coming from a maker that turns out two cigarette rods. The apparatus employs orbiting arms which have pairs of flutes for discrete plain cigarettes and deliver plain cigarettes to the peripheral flutes of two discrete drum-shaped conveyors. The cigarettes in the flutes of one of these discrete conveyors are staggered relative to the cigarettes in the flutes of the other conveyor, and the apparatus of Schumacher further comprises an additional conveyor having peripheral flutes which receive cigarettes from both discrete conveyors so that each flute of the additional conveyor contains two coaxial cigarettes. Rotary conveyors of the type disclosed by Schumacher to transport cigarettes in staggered relation to each other are described in commonly owned U.S. Pat. No. 4,051,947 to Schumacher et al.

The aforementioned commonly owned copending patent applications Ser. Nos. 159,122 and 159,216 of Hinz et al. disclose methods of and machines for making filter cigarettes of unit length. This involves simultaneous severing of two rows of plain cigarettes of unit length so that each such cigarette yields a pair of plain cigarettes of unit length, insertion of a filter mouthpiece of double unit length between each pair of plain cigarettes of unit length, conversion of the thus obtained groups of three coaxial rod-shaped articles each into filter cigarettes of double unit length and subdivision of each filter cigarette of double unit length into two coaxial filter cigarettes of unit length. The thus obtained filter cigarettes of unit length constitute a series of formations of four coaxial filter cigarettes each, and such formations must be converted into different formations, particularly into two rows wherein the filter mouthpieces (of unit length) of all cigarettes in each of the rows face in the same direction.

OBJECTS AND SUMMARY OF THE INVENTION

An object of the invention is to provide a novel and improved method of making filter cigarettes at a rate greatly exceeding the rate of filter cigarette making in accordance with heretofore known methods.

Another method of the invention is to provide a novel and improved method of processing the output of cigarettes makers which turn out several continuous cigarette rods.

A further object of the invention is to provide a method which can be practiced to turn out large numbers of filter cigarettes per unit of time without sacrificing the quality of such products.

An additional object of the invention is to provide a novel and improved filter tipping machine which can be utilized for the practice of the above outlined method and can accept and process the entire output of a maker which turns out several continuous cigarette rods.

Still another object of the invention is to provide a filter tipping machine which produces filter cigarettes at a rate greatly exceeding the output of heretofore known filter tipping machine but whose space rquirements do not appreciably exceed those of conventional machines.

An additional object of the invention is to provide a machine which can accept rod-shaped articles from apparatus of the type disclosed in the aforediscussed copending patent application Ser. No. 127,243 of Schumacher.

A further object of the invention is to provide novel and improved means for transporting rod-shaped articles and uniting bands in the above outlined filter tipping machine.

Another object of the invention is to provide a production line which embodies the above outlined filter tipping machine.

Another object of the invention is to provide a filter tipping machine wherein the filter mouthpieces and the cigarettes are treated gently even though they are processed at a rate which is a multiple of the output of heretofore known cigarettes makers.

A further object of the invention is to provide the filter tipping machine with novel and improved means for staggering, aligning, shuffling, shifting and otherwise manipulating rod-shaped articles which are to be assembled into filter cigarettes.

Another object of the invention is to provide a novel and improved method of manipulating a series of formations of rod-shaped articles (such as filter cigarettes of unit length) wherein each formation includes more than two coaxial articles.

A further object of the invention is to provide a method of converting four rows of coaxial rod-shaped articles of the tobacco processing industry into two rows.

Another object of the invention is to provide a method which is carried out in such a way that the articles are treated rapidly but gently and that the conversion of formations of three or more coaxial articles each into two rows can be completed in a small area and while the articles are transported at an elevated speed at right angles to their respective axes.

An additional object of the invention is to provide an apparatus for the practice of the just outlined method and to provide the apparatus with novel and improved means for staggering, shifting and/or otherwise manipulating the rod-shaped articles of successive formations in a time- and space-saving manner as well as in such a way that the appearance of the articles is not adversely affected as a result of the shuffling, staggering and/or other operations.

Still another object of the invention is to provide novel and improved pneumatic shifting, decelerating and locating means for use in the above outlined apparatus.

A further object of the invention is to provide an apparatus which can be used in the aforediscussed machine of Hinz et al.

One feature of the present invention resides in the provision of a method of manipulating of successive formations of four coaxial rod-shaped articles each, particularly filter cigarettes of unit length, wherein first and second outer articles are respectively adjacent first and second inner articles. The method comprises the steps of advancing successive formations in a predetermined direction substantially at right angles to the axes of the articles, staggering at least the first outer articles of successive formations relation to the inner articles of the respective formations in the predetermined direction, and shifting the thus staggered first outer articles of successive formations axially into alignment with the second inner articles of the respective formations so that the first outer articles and the second inner articles of successive formations form a row of aligned articles.

The method can further comprise the steps of staggering the second outer articles of successive formations in the predetermined direction relative to the inner articles of the respective formations, and shifting the thus staggered second outer articles of successive formations axially into alignment with the first inner articles of the respective formations so that the second outer articles and the first inner articles of successive formations form a second row of aligned articles.

The advancing step can comprise transporting the articles of successive formations on a first conveyor, and each staggering step can include transferring the first and/or second outer articles of successive formations onto a second conveyor. Each staggering step can further comprise transferring the inner articles of successive formations onto a third conveyor.

Another feature of the invention resides in the provision of an apparatus for manipulating successive formations of four coaxial rod-shaped articles each, particularly filter cigarettes of unit length, wherein first and second outer articles are respectively adjacent first and second inner articles and wherein the first and second outer and inner articles of successive formations are aligned with each other. The apparatus comprises means for advancing successive formations in a predetermined direction substantially at right angles to the axes of the articles, means for staggering at least the first outer articles of successive formations relative to the inner articles of the respective formations in the predetermined direction, and means for shifting the thus staggered first outer articles of successive formations axially into alignment with the second inner articles of the respective formations so that the first outer articles and the second inner articles of successive formations form a row of aligned articles.

The apparatus can further comprise means for staggering the second outer articles of successive formations in the predetermined direction relative to the inner articles of the respective formations, and means for shifting the thus staggered second outer articles of successive formations axially into alignment with the first inner articles of the respective formations so that the second outer articles and the first inner articles of successive formations form a second row of aligned articles.

The advancing means preferably comprises at least one rotary conveyor, and each staggering means preferably comprises a second rotary conveyor which receives the first and/or second outer articles of successive formations from the one conveyor. Each shifting means can comprise a third rotary conveyor which receives first and/or second outer articles of successive formations from the second conveyor. Alternatively, the means for shifting the first outer articles can comprise a third rotary conveyor and the means for shifting the second outer articles can comprise an additional rotary conveyor.

In accordance with a presently preferred embodiment of the apparatus, each shifting means comprises a rotary conveyor having a series of axially parallel flutes for the first or second outer articles of successive formations, and means for moving the articles in the flutes axially. Each shifting means can further comprise a shroud or other suitable means for at least substantially sealing successive flutes from the surrounding atmosphere, and the moving means of such shifting means can include means for evacuating air from those flutes which are sealed or substantially sealed from the atmosphere to thereby pull the first or second outer articles axially in the respective flutes. The evacuating means can include suction portions which are provided in the conveyor of such shifting means and communicate with the flutes. The conveyor of the shifting means can further comprise article locating means (e.g., block-shaped or otherwise configurated stops) provided in the flutes and serving to arrest the respective first or second outer articles in predetermined axial positions (of alignment with the second or first inner articles). Still further, the shifting means can comprise means for decelerating the articles which move in the flutes toward engagement with the respective locating means. The decelerating means can include suction ports which are provided in the conveyor of the shifting means and communicate with the flutes. Such suction ports are preferably spaced apart from the locating means in the respective flutes.

The apparatus can further comprise means for moving the inner articles of successive formations axially and away from each other; such moving means can include one or more stationary cams which are located in the path of movement of inner articles in the predetermined direction or pneumatic means for pushing or pulling the inner articles of successive formations axially and away from each other.

Still further, the apparatus can comprise means for turning the articles of the row including the first outer articles and the second inner articles or the second row including the second outer articles and the first inner articles end-for-end. This is important in connection with the manipulation of filter cigarettes of unit length when the filter mouthpieces of the outer articles are adjacent the filter mouthpieces of neighboring inner articles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
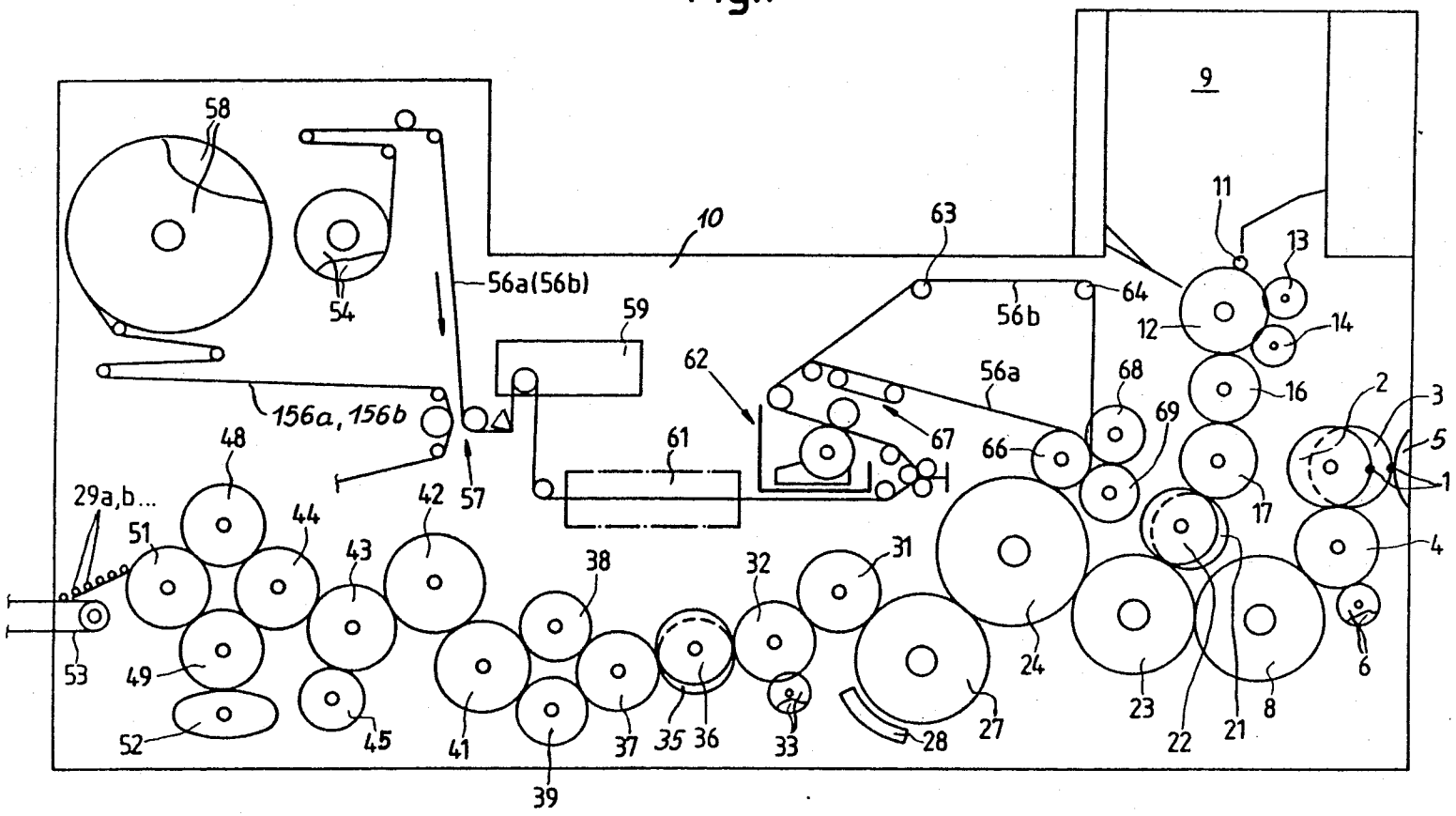
FIG. 1 is a schematic front elevational view of a filter tipping machine including an apparatus which embodies the invention.
Figure 2:
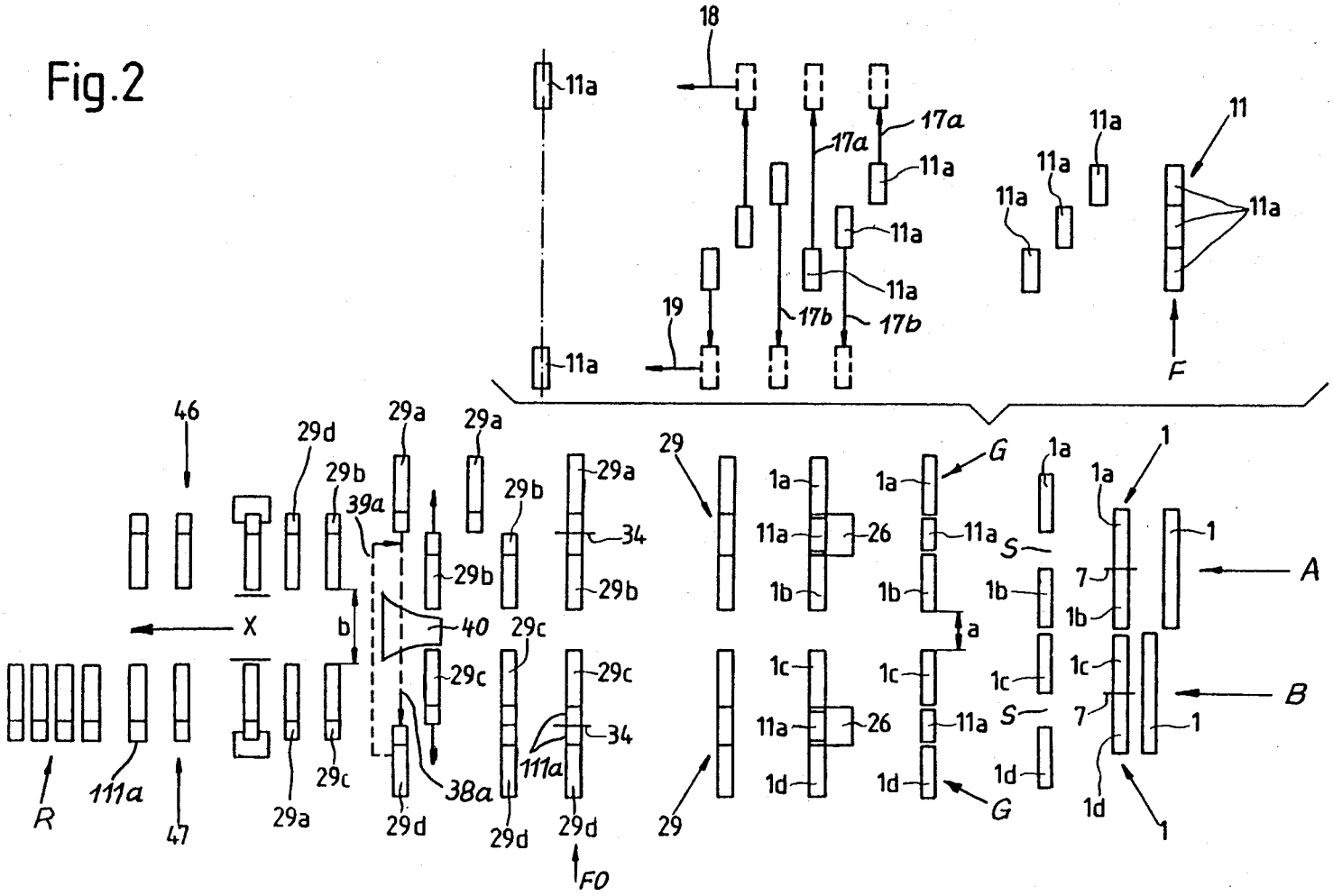
FIG. 2 is a schematic plan view of rod-shaped articles and uniting bands which are manipulated in the machine of FIG. 1, showing the manner in which plain cigarettes and filter mouthpieces are subdivided, shuffled, transported, connected to each other and the resulting filter cigarettes manipulated for the purpose of converting formations of four coaxial filter cigarettes of unit length each into two rows of filter cigarettes.

Referring to FIG. 1, there is shown a filter tipping machine which serves to turn out a single row R of filter cigarettes 29*a*–29*d* of unit length (see FIG. 2) wherein the filter mouthpieces 111a face in the same direction. The character 5 denotes a conveyor which can be similar to or identical with the conveyor 4 shown in the copending patent application Ser. No. 127,243 of Schumacher. The orbiting arms of the conveyor 5 deliver plain cigarettes 1 of double unit length to two discrete rotary drum-shaped conveyors 2, 3 which can be said to correspond to the conveyors 12*a*, 12*b* of Schumacher and serve to deliver pairs of cigarettes 1 into successive axially parallel peripheral flutes a rotary drum-shaped conveyor 4 corresponding to the conveyor 26 of Schumacher. The conveyor 3 delivers a row B and the conveyor 2 delivers a row A of parallel cigarettes 1 in such orientation that the cigarettes in the row A are staggered relative to the cigarettes in the row B (as seen in FIG. 2 in the direction of arrow X indicating the direction of (sidewise or transverse) movement of cigarettes 1 and portions of such cigarettes in the filter tipping machine). The conveyors 2, 3 can be said to constitute an aligning means which ensures that each cigarette 1 of the row A registers with a cigarette 1 of the row B not later than when such cigarettes enter the oncoming axially parallel peripheral flutes of the conveyor 4. The conveyor 4 is one of several conveyors which serve to advance the cigarettes 1 and their portions as well as filter plugs 11*a* of double unit length in the direction of arrow X.

Each cigarette 1 of double unit length on the conveyor 4 is subdivided into two coaxial plain cigarettes 1*a*, 1*b* or 1*c*, 1*d* of unit length during travel in and with the respective flute of the conveyor 4 which cooperates with a subdividing means including two coaxial rotary disc-shaped knives 6 serving to make cuts 7 which are shown in FIG. 2. Each cigarette 1 which is supplied by the conveyor 3 (i.e., each cigarette of the row A) yields two coaxial plain cigarettes 1*a*, 1*b*, and each cigarette 1 of the row B which is supplied by the conveyor 2 yields two coaxial plain cigarettes 1*c*, 1*d*. Pairs of coaxial plain cigarettes 1*a*–1*b* and 1*c*–1*d* of unit length are thereupon transferred into successive axially parallel peripheral flutes of a further advancing conveyor 8 which cooperates with suitable spreading cams (not specifically shown in FIG. 1) serving to respectively move the cigarettes 1*a* and 1*d* axially and away from the aligned cigarettes 1*b*, 1*d* so as to establish gaps or spaces S each having a width at least matching the length of a filter plug or filter mouthpiece 11*a* of double unit length. The spreading cams are placed adjacent the path of movement of plain cigarettes 1*a*, 1*d* with the conveyor 8. Instead of pushing the cigarettes 1*a* and 1*d* away from the respective cigarettes 1*b* and 1*c*, it is equaly within the purview of the invention to pull the cigarettes 1*a* and 1*d* toward the respective end faces of the drum-shaped conveyor 8, e.g., by suction in a manner well known from the art of cigarette making and processing as disclosed, for example, in commonly owned U.S. Pats. Nos. 3,535,003, 3,685,633 and 3,812,950 to Rudszinat et al. Mechanical shifting means for cigarettes in the flutes of rotary drum-shaped conveyors are disclosed in commonly owned U.S. Pat. No. 4,564,029 to Hinzmann et al. and in commonly owned U.S. Pat. No. Re. 25,917 to Stelzer.

The frame or housing 10 of the filter tipping machine supports a magazine 9 which constitutes a source of supply of filter mouthpieces 11 of six times unit length. The outlet in the bottom part of the magazine 9 is located above the path of movement of axially parallel flutes at the periphery of a rotary drum-shaped withdrawing conveyor 12 which transports the filter mouthpieces 11 sideways (i.e., at right angles to their respective axes) and past two rotary disc-shaped knives 13, 14 which serve as a means for subdividing each mouthpieces 11 into a file F of three coaxial filter mouthpieces 11*a* of double unit length. The knives 13, 14 are staggered relative to each other in the circumferential direction of the withdrawing conveyor 12 and are spaced apart from each other in the axial direction of this conveyor. The withdrawing conveyor 12 delivers successive files F of three filter mouthpieces 11*a* each to a rotary staggering conveyor 16 which has three discs or wheels each receiving one filter mouthpiece 11*a* of a file F and each serving to advance the respective mouthpiece 11*a* through a different distance and/or at a different speed so that each file F is converted into a set of three filter mouthpieces 11*a* which are staggered relative to each other in a manner as shown in FIG. 2 immediately to the left of the file F. Reference may be had to commonly owned U.S. Pat. No. 3,308,832 to Stelzer et al. This provides room for axial shifting of some or all of the filter mouthpieces 11*a* on a further rotary drum-shaped conveyor 17 which receives mouthpieces 11*a* from the staggering conveyor 16. As can be seen in FIG. 2, the rearmost filter mouthpiece 11*a* of each file F is moved by a schematically shown shifting means 17*a* in a direction away from the other two filter mouthpieces 11*a* of the same file, the median mouthpiece 11*a* of the file F is moved by a schematically shown shifting means 17*b* in the opposite direction, the foremost mouthpiece 11*a* of the same file is shifted by a shifting means 17*a* in the same direction as the rearmost mouthpiece 11*a*, the rearmost mouthpiece 11*a* of the preceding file F is shifted by a shifting means 17*b* of the conveyor 17, and so forth so that the files F are converted into two successions or rows 18, 19 of parallel filter mouthpieces 11*a* which advance in a direction to the left as seen in FIG. 2. The filter mouthpieces 11*a* of the succession 18 are staggered relative to the filter mouthpieces 11*a* of the succession 19 and, therefore, the machine further comprises two rotary drum-shaped aligning conveyors 21, 22 which can operated in a manner analogous to that of the conveyors 2, 3 (see also commonly owned U.S. Pat. No. 3,164,242 to Schubert et al.) in order to ensure that each mouthpiece 11*a* of the succession 18 is aligned with a mouthpiece of the succession 19 before or not later than when the thus obtained pairs of coaxial mouthpieces 11*a* are introduced (by the conveyors 21, 22) into the sapces S between the oncoming pairs of coaxial cigarettes 1*a*, 1*b* and 1*c*, 1*d* of unit length. This takes place in successive flutes at the periphery of a further rotary drum-shaped advancing conveyor 23; such flutes receive pairs of plain cigarettes 1*a*–1*b* and 1*c*–1*d* of unit length from successive flutes of the aforementioned drum-shaped conveyor 8.

The shifting means 17*a*, 17*b* of the conveyor 17 can constitute cams or they can include suction ports (see also FIG. 3) which are provided in the flutes of the conveyor 17 and are connected, at appropriate intervals, to a suitable suction generating device (such as a fan) in order to draw the filter mouthpieces 11*a* in directions to assemble oddly numbered mouthpieces 11*a* into the succession 18 and to assemble evenly numbered mouthpieces 11*a* into the succession 19 or vice versa. It is also possible to blow the filter mouthpieces 11*a* in parallelism with the axis of the shifting conveyor 17 against suitable stops to thus form the succession 18 and 19. All that counts is to ensure that the mutual spacing of filter mouthpieces 11*a* which form the successions 18 and 19 matches the mutual spacing of gaps S in the flutes of the conveyor 23 which latter can be called an assembly conveyor in that its flutes gather groups G of three coaxial rod-shaped articles each, namely two plain cigarettes 1*a*–1*b* or 1*c*–1*d* of unit length and a filter mouthpiece 11*a* of double unit length between them. The conveyor 23 cooperates with suitable condensing means in the form of stationary cams or the like which serve to ensure that the inner end portions of the pairs of cigarettes 1*a*–1*b* and 1*c*–1*d* actually abut the respective end faces of the filter mouthpieces 11*a* between them prior to conversion of each group G into a filter cigarette 29 of double unit length.

The condensing means which cooperate with the conveyor 23 cause the development of clearances a (FIG. 2) between neighboring plain cigarettes 1*b*, 1*c* in successive flutes of the conveyor 23, and such clearances can be increased in order to ensure that the cigarettes 1*a*–1*b* and 1*c*–1*d* actually abut the respective filter mouthpieces 11*a* not later than at the time of conversion of groups G into filter cigarettes 29 of double unit length. Such conversion takes place on two additional rotary drum-shaped conveyors 24, 27 of the means for advancing plain cigarettes 1, their portions 1*a*–1*d* and filter mouthpieces 11*a* in the direction of arrow X.

The conveyor 24 advances successive pairs of coaxial groups G past a station where each such group is provided with an adhesive-coated uniting band 26. The bands 26 are applied in such a way that they extend substantially tangentially of the respective groups G and contact the respective filter mouthpieces 11*a* (all the way from the one to the other axial end) as well as the adjacent inner end portions of the respective cigarettes 1*a*–1*b* or 1*c*–1*d*. The conveyor 24 delivers successive pairs or coaxial groups G onto the conveyor 27 which constitutes one component of a means for rolling or convoluting the adhesive-coated uniting bands 26 around the respective gropus G to thereby connect each filter mouthpiece 11*a* with the adjacent plain cigarettes 1*a*–1*b* or 1*c*–1*d* and to thus complete the conversion of groups G and uniting bands 26 into filter cigarettes 29 of double unit length.

The conveyor 27 cooperates with an adjustable stationary rolling device 28 to define therewith an arcuate channel wherein successive coaxial pairs of groups G roll about their respective axes to thus transform each uniting band 26 into a tube which sealingly surrounds the respective filter mouthpiece 11*a* and the adjacent end portions of the aligned plain cigarettes 1*a*–1*b* or 1*c*–1*d*. Thus, the rod-shaped commodities which leave the arcuate passage between the conveyor 26 and the rolling device 28 are filter cigarettes 29 of double unit length which are advanced as pairs of coaxial filter cigarettes and are delivered into successive flutes of a rotary drum-shaped conveyor 31 cooperating with a laser or with another suitable device for making perforations in the wrappers of filter cigarettes 29, namely at least one set of perforations in each half of each cigarette 29. The thus obtained so-called ventilating or aerating zones of the wrappers permit entry of atmospheric air which is admixed to the column of tobacco smoke when an individual filter cigarette (article) 29*a*, 29*b*, 29*c* or 29*d* of unit length is lighted. A device which can be used in the machine of FIG. 1 in conjunction with the conveyor 31 is disclosed in commonly owned U.S. Pat. No. 4,281,670 to Heitmann et al. Rolling devices which can be adapted for use in the machine of FIG. 1 (at 27, 28) are disclosed in commonly owned U.S. Pat. No. 3,527,234 to Hinzmann.

The conveyor 31 delivers pairs of filter cigarettes 29 (each such filter cigarettes is provided with two sets of perforations, one set for the cigarette 29*a* or 29*c* and the other set for the cigarette 29*b* or 29*d*) into successive axially parallel peripheral flutes of a combined severing or subdividing and advancing conveyor 32 cooperating with two coaxial rotary disc-shaped knives 33 so as to subdivide each filter cigarette 29 into two filter cigarettes (articles) 29*a*, 29*b* or 29*c*, 29*d* of unit length. The knives 33 make cuts 34 (FIG. 2) midway across the convoluted uniting bands so that the filter mouthpiece 111*a* of unit length of the cigarette 29*a* is adjacent the filter mouthpiece 111*a* of unit length of the cigarette 29*b* and that the filter mouthpieces of coaxial cigarettes 29*c*, 29*d* are also adjacent each other.

The thus obtained formations FO jointly form four rows of filter cigarettes (articles) 29*a*–29*d* of unit length and the four rows are thereupon transformed into two rows in accordance with my method. In the first step, a rotary drum-shaped conveyor 36 receives from the advancing conveyor 32 successive files of three filer cigarettes 29*b*–29*d* each whereas a rotary drum-shaped staggering conveyor 35 receives successive outer filter cigarettes 29*a*. The conveyor 35 staggers the outer cigarettes 29*a* relative to the inner cigarettes 29*b*, 29*c* and outer cigarettes 29*d*. The conveyors 35, 36 deliver the cigarettes 29*a*–29*d* (with the outer cigarette 29*a* staggered relative to the cigarettes 29*b*–29*d*) to a rotary drum-shaped transfer conveyor 37 which, in turn, delivers the cigarettes 29*a*–29*c* to an upper rotary drum-shaped shifting conveyor 38 while delivering the cigarettes 29*d* to a lower rotary drum-shaped shifting conveyor 39. The outer cigarettes 29*a* which travel with the conveyor 38 are shifted axially by shifting means 38*a* to be described in connection with FIG. 3 toward positions of alignment (as seen in the direction of arrow X) with the inner cigarettes 29*c*, and the outer cigarettes 29*d* are shifted by shifting means 39*a* toward positions of alignment with the inner cigarettes 29*b* (it will be noted that the filter mouthpieces 111*a* of the cigarettes 29*a*, 29*c* and 29*b*, 29*d* face in the same direction). The shifting means 38*a* and 39*a* can mechanically and/or pneumatically push or pull the first and second outer cigarettes 29*a* and 29*d* in their respective flutes. The result of such shifting on the conveyors 38, 39 is that the first outer filter cigarettes 29*a* and the second inner filter cigarettes 29*c* form a first row 47 and the first inner cigarettes 29*b* and second outer cigarettes 29*d* form a second row 46. The mutual spacing of cigarettes 29*a*, 29*c* and 29*b*, 29*d* in the rows 47, 46 is shown at b.

The shifting conveyors 38, 39 transfer the rows 47, 46 of filter cigarettes 29*a*, 29*c* and 29*b*, 29*d* onto a first rotary drum-shaped testing conveyor 41 on which the head ends of the cigarettes 29*a*–29*d* can be tested for density (such testing is desirable in order to detect filter cigarettes wherein the free ends of the respective plain cigarettes 1*a*, 1*b*, 1*c* or 1*d* are too soft and are likely to lose additional tobacco which is a frequent cause of annoyance to smokers because it contaminates the packet, the pocket or the purse of the smoker). The manner of testing the ends of tobacco-containing portions of filter cigarettes is well known in the art and is disclosed in numerous U.S. and foreign patents of the assignee of the present application.

The testing conveyor 41 delivers the rows 47, 46 of filter cigarettes 29*a*, 29*c* and 29*b*, 29*d* of unit length to a second rotary drum-shaped testing conveyor 42 which comprises or cooperates with means for testing the condition of wrappers of the cigarettes 29*a*–29*d* for the presence of smudges, frayed ends, holes, open seams and/or other defects. The assignee of the present application owns numerous U.S. and foreign patents which describe presently preferred modes of testing the wrappers of rod-shaped articles of the tobacco processing industry.

Defective cigarettes 29*a*, 29*b*, 29*c* and/or 29*d* are segregated from satisfactory cigarettes on a further rotary drum-shaped conveyor 43 which cooperates with a suitable (e.g., pneumatic) ejecting or expelling device serving to segregate defective cigarettes (i.e., those found to be defective during travel with the conveyor 41 and/or 42) from satisfactory cigarettes. The conveyor 43 delivers satisfactory filter cigarettes 29*a*–*d* to the flutes of a further rotary drum-shaped conveyor 44. A rotary drum-shaped conveyor 45 can be activated, when necessary, in order to withdraw samples of cigarettes 29*a*–29*d* for testing in a laboratory independently of the testing operations which are carried out during travel of filter cigarettes with the testing conveyors 41 and 42. Such inspection of selected batches of filter cigarettes serves to ascertain the quality of testing on the conveyors 41, 42 and/or to carry out other tests which are not or cannot be carried out during travel of filter cigarettes with the conveyors 41–42.

The conveyor 44 can be said to constitute one conveyor of a turn-around device which further comprises rotary drum-shaped conveyors 48, 49, 51 and a conical or otherwise configured inverting unit 52, e.g., of the type disclosed in commonly owned U.S. Pat. No. 3,583,546 to Koop or in commonly owned U.S. Pat. No. 3,176,825 to Rudszinat et al.

The conveyor 44 delivers the row 46 of cigarettes 29*b*, 29*d* to the flutes of the conveyor 49 while delivering the row 47 of cigarettes 29*a*, 29*c* to the flutes of the conveyor 48. The inverting unit 52 cooperates with the conveyor 49 to invert the cigarettes 29*b*, 29*d* of the row 46 end-for-end and to place the inverted cigarettes into alternate flutes of the rotary drum-shaped conveyor 51 which further receives non-inverted cigarettes 29*a*, 29*c* (row 47) from the conveyor 48. This entails a conversion of the rows 46, 47 into a single row R wherein the filter mouthpieces 111*a* of all cigarettes 29*a*–29*d* face in the same direction. The conveyor 51 delivers the single row R onto the upper reach of an endless belt conveyor 53 which can transport the cigarettes 29*a*–29*d* to storage or directly into a packing machine, not shown. The mutual spacing of flutes at the periphery of the conveyor 51 is half the mutual spacing of flutes at the periphery of the conveyor 48 or 49.

The filter tipping machine further comprises means for supplying to the assembly conveyor 24 two seriers of uniting bands 26 for application to successive pairs of groups G. To this end, the frame 10 of the filter tipping machine supports two coaxial expiring reels 54 of stips or webs 56*a*, 56*b* of tipping paper (e.g., cigarette paper or artificial cork) which advance along separate paths, preferably in such a way that the path portions immediately downstream of the expiring reels 54 are closely or immediately adjacent each other. The webs 56*a*, 56*b* first advance through splicing devices 57 (e.g., of the type disclosed in commonly owned U.S. Pat. No. 3,586,006 to Wendt which are activated when the supply of tipping paper on the respective reel 54 is exhausted so as to splice the trailing end of the web 56*a* or 56*b* to the leader of a fresh web 156*a* or 156*b* stored on one of two coaxial fresh bobbins or reels 58.

The splicing devices 57 are followed by a web guide 59 which defines two accurately determined routes or paths for the webs 56*a*, 56*b* to thus ensure that the webs cannot stray laterally during entry into and during travel through a web perforating device 61 which is indicated in FIG. 1 by phantom lines because it constitutes an optional feature of the filter tipping machine. This perforating device 61 can be used in addition to or in lieu of the perforating means including the conveyor 31. As a rule, the perforating device 61 will be used in lieu of the perforating means including the conveyor 31 or vice versa. Web perforating devices are disclosed in the aforementioned U.S. Pat. No. 4,281,670 to Heitmann et al.

The webs 56*a*, 56*b* are then transported through a paster or through two discrete pasters 62 serving to provide one side of each web with a film of suitable adhesive before the webs 56*a*, 56*b* advance, along separate routes, to a rotary drum-shaped suction conveyor 66 which cooperates with two rotary knife carriers 68, 69 having orbiting knives serving to subdivide the webs 56*a*, 56*b* into two series of discrete uniting bands 26. The webs 56*a*, 56*a* must be moved apart (i.e., at least one of these webs must be moved at right angles to the plane of FIG. 1) in order to establish between the two webs a clearance which corresponds to that between the two uniting bands 26 shown in FIG. 2 (on the conveyor 24). The web 56*b* is advanced from the paster or pasters 62 to move along guide rollers 63, 64 and thereupon to the periphery of the suction conveyor 66. The peripheral surface of the conveyor 66 is formed with suction ports to attract the leaders of the webs while the leaders are severed by successive axially parallel knives of the knife carrier 69 (web 56*b*) or 68 (web 56*a*). The angle along which the leader of the web 56*b* extends in contact with the peripheral surface of the conveyor 66 must be sufficiently large to ensure that the conveyor 66 can maintain the web 56*b* under tension. Successive uniting bands 26 which are obtained as a result of severing of the leader of the web 56*b* are attracted to the peripheral surface of the conveyor 66 by suction during travel from the knife carrier 69 to the transfer station between the conveyors 24, 66 where the adhesive-coated sides of the uniting bands 26 come in contact with the oncoming groups G on the conveyor 24.

Successive increments of the web 56*a* are caused to cover a shorter distance on their way from the paster or pasters 62 to the periphery of the suction conveyor 66. Such increments are diverted or deflected toward the observer of FIG. 1 by a deflecting device 67 so as to move away from the path of the web 56*b* and into the range of successive axially parallel orbiting knives on the rotary knife carrier 68 to sever the leader of the web 56*a* at regular intervals and to thus form the other series of discrete uniting bands 26.

The peripheral speed of the suction conveyor 66 can slightly exceed the speed of the webs 56*a*, 56*b* so that the peripheral surface of the conveyor 66 slips relative to the webs in order to ensure that successively formed uniting bands 26 are slightly spaced apart from one another and, therefore, a next-following uniting band cannot interfere with the application of the preceding uniting band to the oncoming group G on the assembly conveyor 24.

The conveyor 66 can cooperate with the knife carriers 68, 69 in a manner as disclosed in commonly owned U.S. Pat. No. 3,340,757 to Rudszinat or in a manner as disclosed in commonly owned U.S. Pat. No. 4,503,867 to Barbe et al.

Figure 3:
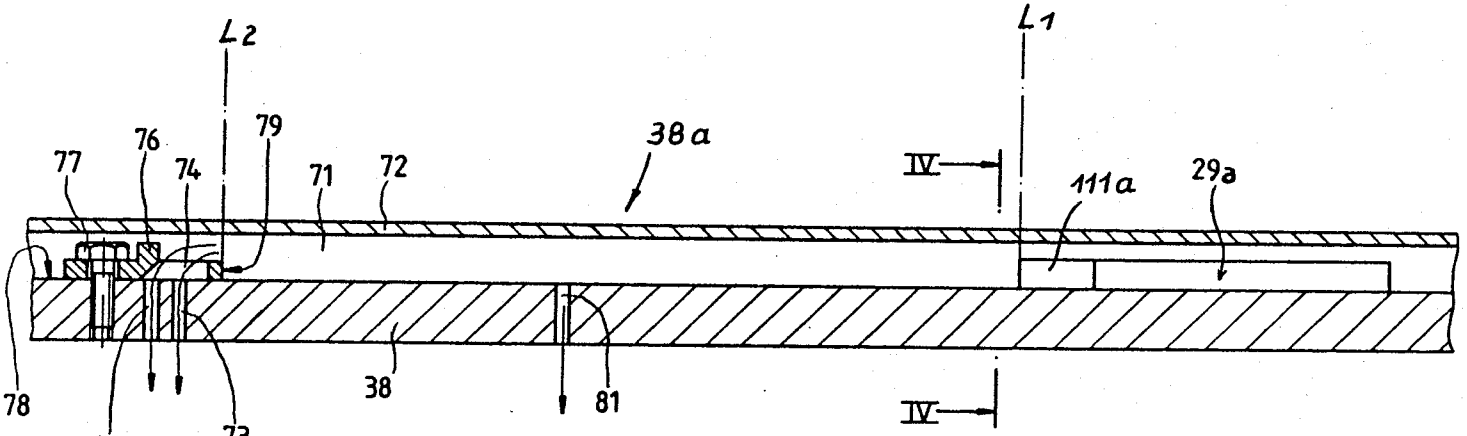
FIG. 3 is an enlarged fragmentary axial sectional view of a shifting unit in the apparatus of FIG. 1.
Figure 4:
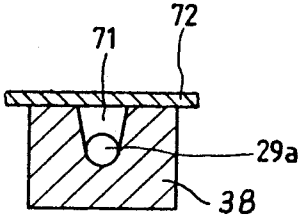
FIG. 4 is a sectional view as seen in the direction of arrows from the line IV—IV of FIG. 3.

FIGS. 3 and 4 show the shifting means for the outer filter cigarettes 29*a* or 29*d* so as to place such filter cigarettes into alignment with the second and first inner cigarettes 29*c*, 29*b*, respectively. It is assumed here that the rotary conveyor of FIGS. 3 and 4 is the conveyor 38 with shifting means (38*a*) for the first outer filter cigarettes (articles) 29*a* of successive formations FO. Such formations are advanced by the conveyor 32, and the conveyor 35 staggers the cigarettes 29*a* of successive formations FO relative to the cigarettes 29*b*–29*d* of the respective formations by moving the cigarettes 29*a* in the direction of the arrow X, i.e., at right angles to the axes of the cigarettes 29*a*–29*d*.

The conveyor 38 has a series of axially parallel peripheral flutes 71 (only one shown in FIGS. 3–4) which are equidistant from each other in the circumferential direction of the conveyor 38 and advance seriatim along the concave side of a suitably configurated shroud 72 which at least substantially seals such flutes from the surrounding atmosphere after the flutes receive cigarettes 29*a* from the conveyor 37. The latter receives cigarettes 29*a*–29*d* (with the cigarette 29*a* staggered relative to the cigarettes 29*b*–29*d*) from the conveyors 35, 36. The cigarettes 29*a*–29*c* are transferred onto the conveyor 38 and the cigarettes 29*d* are transferred onto the conveyor 39 which staggers them relative to the cigarettes 29*a*–29*c* and whose shifting means 39*a* shifts the cigarettes 29*d* axially into alignment with the cigarettes 29*b* on the conveyor 38.

The shifting means 38*a* of FIGS. 3 and 4 comrpises means for evacuating air from successive flutes 71 which advance along the shroud 72 to thereby pull the respective cigarettes 29*a* axially in a direction to the left, as seen in FIG. 3, namely toward positions of alignment with the cigarettes 29*c* of the respective formations FO. Such positions are determined by locating means in the form of block-shaped abutments or stops 76 which are installed in the bottom portions of the flutes 71 and are affixed to the body of the conveyor 38 by screws 77 or other suitable fasteners. Each filter cigarette 29*a* must cover a considerable distance on its way from the initial axial position in its flute 71 toward a predetermined position of abutment with the end face 79 of the respective locating means 76. The aforementioned evacuating means serves to move the cigarettes 29*a* axially and includes suction ports 73 whose intake ends draw air from the respective flute 71 by way of an aperture or slot 74 in the locating means 76. The suction ports 73 are connectable to a suction generating device (not shown), such as a fan or the like. The pull upon the cigarette 29*a* in the flute 71 is quite pronounced so that the cigarette undergoes rapid acceleration and travels toward the end face 79 at a high speed such as could cause deformation of or other damage to the filter mouthpiece 111*a* of unit length. Therefore, the shifting means 38*a* of FIGS. 3–4 further comprises means for braking or decelerating the cigarettes 29*a* on their way from the starting positions toward abutment with the end faces 79 in the respective flutes 71. The decelerating means includes suction ports 81 which are machined into the body of the conveyor 38 and communicate with the deepmost portions of the flutes 71 as well as with the aforementioned suction generating device or with a discrete second suction generating device. The suction ports 81 of the decelerating means are spaced apart from the locating means 76 in the respective flutes 71.

In order to move a cigarette 29a from the starting position (locus $L_1$) to the shifted position (locus $L_2$) of engagement with the end face 79 of the locating means 76 in the respective flute 71, the suction ports 73 are connected with the suction generating device in a manner which is well known from the art of transporting rod-shaped articles of the tobacco processing industry and disclosed, for example, in the aforementioned U.S. Pats. Nos. 3,535,003, 3,685,633 and 3,812,950 to Rudszinat et al. This entails rapid acceleration of the cigarette 29a from the locus $L_1$ toward the locus $L_2$. The suction ports 73 are then sealed from the suction generating device and the latter (or another suction generating device) is connected with the port 81 which decelerates the cigarette 29a on its way toward the locating means 76 by attracting it to the surface 78 at the bottom of the flute 71 and can bring the cigarette 29a to a full stop. In the final step, the suction port 81 is sealed from the suction generating device and the suction ports 73 are again connected to the suction generating device so as to induce the cigarette 29a to carry out the last stage of its axial movement toward and into engagement with the end face 79 of the locating means 76, i.e., to a position of alignment with the second inner cigarette 29c of the respective formation FO.

The manner in which the second outer cigarettes 29d of successive formations FO are shifted axially in the flutes of the conveyor 39 is analogous to that described in connection with FIGS. 3 and 4. The cigarettes 29d are moved to positions of alignment with the first inner cigarettes 29b of the respective formations FO to form therewith the row 46. Successive cigarettes (29b, 29d, 29b, 29d . . . and 29a, 29c, 29a, 29c . . .) of the rows 46, 47 are transferred into successive flutes of the conveyor 41 so that the latter can transport the rows 46, 47 toward and onto the conveyor 42.

FIG. 2 shows a stationary cam 40 which constitutes a means for spreading the inner cigarettes 29b, 29c of successive formations FO, i.e., for moving such cigarettes axially and away from each other so as to increase the width of the clearance between the cigarettes 29b, 29c to b. The cam 40 can be placed adjacent the path of inner cigarettes 29b, 29c on the conveyor 38 or 41.

An advantage of the improved filter tipping machine and its article manipulating apparatus is its compactness as well as its simplicity. The output of the machine is a multiple of the output of a conventional machine which processes a single row of plain cigarettes of double unit length. Such earlier machines are disclosed, for example, in commonly owned U.S. Pats. Nos. 3,245,414 and 3,306,306 to Rudszinat and in commonly owned U.S. Pat. No. Re. 26,900 to Bohn et al. The improved machine can employ simple rotary conveyors which can be disposed in pairs and whose drives can be readily synchronized in a manner well known from the art of conventional filter tipping machines. This applies for the conveyors which transport plain cigarettes and filter cigarettes as well as for the conveyors which transport filter mouthpieces to the transfer station between the conveyors 21-22 and 23.

The feature that the machine transports and processes pairs of initially staggered and thereupon aligned cigarettes of double unit length renders it possible to directly couple the machine to existing transfer mechanisms (such as the aforementioned transfer mechanism of Schumacher) which receive plain cigarettes of double unit length from makers wherein plural cigarette rods are converted into plain cigarettes. The conveyors which define the path for the cigarettes of the row A can be coaxial or integral with the conveyors for the cigarettes of the row B. This renders it possible to achieve significant savings in space and to simplify the drive means for the conveyors.

The knives 13, 14 can be mounted in such a way that they rotate about a common axis (to simplify the drive means for the knives). The illustrated construction (according to which the knives 13, 14 are staggered relative to each other in the circumferential direction of the withdrawing conveyor 12) is preferred at this time because the knives 13, 14 are more readily accessible for inspection, sharpening or replacement. The knives 13, 14 can be mounted, and the withdrawing conveyor 12 can be designed, in a manner as disclosed in commonly owned U.S. Pat. No. 4,554,931 to Born.

The method and apparatus of the present invention render it possible to convert four rows of rod-shaped articles (29a–29d) into two rows 46, 47 in a simple and space-saving manner and without affecting the appearance and/or other desirable characteristics of the articles. Gentle treatment of the articles is important because this ensures that the articles are not ejected on the conveyor 43 in response to signals from testing instrumentalities on or adjacent the testing conveyors 41 and 42. Moreover, such gentle treatment ensures that the eye-pleasing appearance of the articles remains unchanged in spite of their manipulation on the way from the severing conveyor 32 to and beyond the testing conveyors 41, 42. Eye-pleasing appearance is an important attribute of filter cigarettes and other rod-shaped articles of the tobacco processing industry.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of manipulating successive formations of four coaxial rod-shaped articles each, particularly filter cigarettes, wherein first and second outer articles are respectively adjacent first and second inner articles, comprising the steps of advancing successive formations in a predetermined direction substantially at right angles to the axles of the articles; staggering the first outer articles of successive formations relative to the inner articles of the respective formations in said predetermined direction; shifting the thus staggered first outer articles of successive formations axially into alignment with the second inner articles of the respective formations so that the first outer articles and the second inner articles of successive formations form a first row of aligned articles; staggering the second outer articles of successive formations in said predetermined direction relative to the inner articles of the respective formations; and shifting the thus staggered second outer articles of successive formations axially into alignment with the first inner articles of the respective formations so that the second outer articles and the first inner articles of successive formations form a second row of aligned articles, said arrows extending in said predetermined direction.

2. The method of claim 1, wherein said advancing step comprises transporting the articles of successive formations on a first conveyor and said step of staggering said first outer articles includes transferring the first outer articles of successive formations onto a second conveyor.

3. The method of claim 2, wherein said step of staggering said first outer articles further comprises transferring the inner articles of successive formations onto a third conveyor.

4. Apparatus for manipulating successive formations of four coaxial rod-shaped articles each, particularly filter cigarettes, wherein first and second outer articles are respectively adjacent first and second inner articles, comprising means for advancing successive formations in a predetermined direction substantially at right angles to the axes of the articles; means for staggering the first outer articles of successive formations relative to the inner articles of the respective formations in said predetermined direction; means for shifting the thus staggered first outer articles of successive formations into alignment with the second inner articles of the respective formations so that the first outer articles and the second inner articles of successive formations form a first row of aligned articles; means for staggering the second outer articles of successive formations in said predetermined direction relative to the inner articles of the respective formations; and means for shifting the thus staggered second outer articles of successive formations axially into alignment with the first inner articles of the respective formations so that the second outer articles and the first inner articles of successive formations form a second row of aligned articles, said rows extending in said predetermined direction.

5. The apparatus of claim 4, wherein said advancing means comprises at least one rotary conveyor.

6. The apparatus of claim 5, wherein said means for staggering the first outer articles comprises a second rotary conveyor which receives the first outer articles of successive formations from said at least one conveyor.

7. The apparatus of claim 6, wherein said means for shifting the staggered first outer articles comprises a third rotary conveyor which receives first outer articles of successive formations from said second conveyor.

8. The apparatus of claim 7, wherein said means for shifting the second outer articles of successive formations comprises an additional rotary conveyor.

9. The apparatus of claim 4, wherein said means for shifting the staggered first outer articles comprises a rotary conveyor having a series of axially parallel flutes for the first outer articles of successive formations, and means for moving the articles in said flutes axially.

10. The apparatus of claim 9, further comprising means for at least substantially sealing successive flutes of said series from the surrounding atmosphere, said moving means including means for evacuating air from the flutes which are sealed from the atmosphere.

11. The apparatus of claim 10, wherein said evacuating means includes suction ports provided in said conveyor and communicating with said flutes.

12. The apparatus of claim 10, wherein said conveyor comprises article locating means provided in said flutes and arranged to arrest the respective first outer articles in predetermined axial positions.

13. The apparatus of claim 4, further comprising means for moving the inner articles of successive formations axially and away from each other.

14. The apparatus of claim 4, further comprising means for turning said aligned articles of said first row end-for-end.

15. Apparatus for manipulating successive formations of four coaxial rod-shaped articles each, particularly filter cigarettes, wherein first and second outer articles are respectively adjacent first and second inner articles, comprising means for advancing successive formations in a predetermined direction substantially at right angles to the axes of the articles; means for staggering at least the first outer articles of successive foramtions relative to the inner articles of the respective formations in said predetermined direction; means for shifting the thus staggered first outer articles of successive formations into alignment with the second inner articles of the respective formations so that the first outer articles and the second inner articles of successive formations form a row of aligned articles, said shifting means comprising a rotary coneyor having a series of axially parallel flutes for the first outer articles of successive formations, and means for moving the articles in said flutes axially, said conveyor comprising article locating means provided in said flutes and arranged to arrest the respective first outer articles in predetermined axiall positions; means for at least substantially sealing successive flutes of said series from the surrounding atmosphere, said moving means including means for evacuating air from the flutes which are sealed from the atmosphere and said row extending in said predetermined direction; and means for decelerating the articles which move in said flutes toward engagement with the respective locating means.

16. The apparatus of claim 15, wherein said decelerating means includes suction ports provided in said conveyor and communicating with said flutes.

17. The apparatus of claim 16, wherein said suction ports are spaced apart from the locating means in the respective flutes.

* * * * *

UNITED STATES PATENT AND TRADEMARK OFFICE

CERTIFICATE OF CORRECTION

PATENT NO. : 4,823,932

DATED : April 25, 1989

INVENTOR(S) : Werner Hinz

It is certified that error appears in the above-identified patent and that said Letters Patent is hereby corrected as shown below:

Title page, item [30]: "3706573" should read --3706753--.
Col. 2, line 50, "method" should read --object--.
Col. 8, line 39, "gropus" should read --groups--;
line 52, "26" should read --27--.
Col. 9, line 4, "cigarettes" should read --cigarette--.
Col. 15, line 1, "arrows" should read --rows--.

Signed and Sealed this

Twenty-fourth Day of July, 1990

*Attest:*

HARRY F. MANBECK, JR.

*Attesting Officer*

*Commissioner of Patents and Trademarks*